US010702894B2

(12) United States Patent
Brandt Sanz et al.

(10) Patent No.: US 10,702,894 B2
(45) Date of Patent: Jul. 7, 2020

(54) SEAL CLEANER AND PROCESS FOR SOLUBLE UNIT DOSE POUCHES CONTAINING GRANULAR COMPOSITION

(71) Applicant: The Procter & Gamble Company, Cincinnati, OH (US)

(72) Inventors: Miguel Brandt Sanz, Tervuren (BE); Luis Martin De Juan, Whitley Bay (BE)

(73) Assignee: The Procter & Gamble Company, Cincinnati, OH (US)

( * ) Notice: Subject to any disclaimer, the term of this patent is extended or adjusted under 35 U.S.C. 154(b) by 311 days.

(21) Appl. No.: 15/623,477

(22) Filed: Jun. 15, 2017

(65) Prior Publication Data

US 2017/0368580 A1 Dec. 28, 2017

Related U.S. Application Data

(60) Provisional application No. 62/354,267, filed on Jun. 24, 2016.

(51) Int. Cl.

| | |
|---|---|
| ***B08B 5/02*** | (2006.01) |
| ***B65B 47/08*** | (2006.01) |
| ***B65B 47/10*** | (2006.01) |
| ***B65B 9/04*** | (2006.01) |
| ***B65B 1/02*** | (2006.01) |
| ***B65B 61/06*** | (2006.01) |
| ***B08B 5/04*** | (2006.01) |
| ***B65B 47/02*** | (2006.01) |
| ***B65B 65/00*** | (2006.01) |

(Continued)

(52) U.S. Cl.

CPC ..... *B08B 5/02* (2013.01); *B08B 5/043* (2013.01); *B65B 1/02* (2013.01); *B65B 9/042* (2013.01); *B65B 9/045* (2013.01); *B65B 47/02* (2013.01); *B65B 47/08* (2013.01); *B65B 47/10* (2013.01); *B65B 61/06* (2013.01); *B65B 65/00* (2013.01); *B65D 65/46* (2013.01); *C11D 17/042* (2013.01)

(58) Field of Classification Search

CPC ..... B65B 55/24; B65B 1/02; B65B 9/042; B65B 9/08; B65B 9/10; B65B 47/02; B65B 47/08; B65B 47/10; B65B 2009/047; B65B 2009/063; B08B 5/02; B08B 5/023; B08B 5/026; B08B 5/04; B08B 5/043; B08B 5/046; B08B 6/00; B08B 9/20; C11D 17/042

USPC ..... 53/167, 453, 559

See application file for complete search history.

(56) References Cited

U.S. PATENT DOCUMENTS

| | | | |
|---|---|---|---|
| 3,055,403 | A | 9/1962 | Barresi |
| 3,218,776 | A | 11/1965 | Cloud |

(Continued)

FOREIGN PATENT DOCUMENTS

| | | | |
|---|---|---|---|
| EP | 0188832 | A2 | 7/1986 |
| EP | 0225494 | B1 | 2/1991 |

(Continued)

OTHER PUBLICATIONS

International Search Report for International Application Serial No. PCT/US2017/038131, dated Sep. 4, 2017, 13 pages.

*Primary Examiner* — Orlando E Aviles
*Assistant Examiner* — Robert F Neibaur
(74) *Attorney, Agent, or Firm* — Gary J. Foose

(57) ABSTRACT

An apparatus and process for cleaning seals of soluble unit dose pouches containing granular composition.

10 Claims, 6 Drawing Sheets

(51) Int. Cl.
*B65D 65/46* (2006.01)
*C11D 17/04* (2006.01)

(56) References Cited

U.S. PATENT DOCUMENTS 4,340,136 A 7/1982 Hanrot et al.
4,555,894 A 12/1985 Illy
4,638,907 A * 1/1987 Bedenk ..... A47L 13/17 162/109
4,817,788 A 4/1989 Bedenk et al.
4,996,824 A * 3/1991 Torterotot ..... B65B 55/025 422/26
5,040,353 A * 8/1991 Evans ..... B07C 5/3404 209/644
5,195,294 A 3/1993 Baranowski
5,226,863 A 7/1993 Kimura
5,875,824 A 3/1999 Atwell et al.
7,127,874 B2 10/2006 Viltro et al.
7,302,727 B2 * 12/2007 Azmoun ..... B65B 55/24 15/101
7,617,562 B2 * 11/2009 Schmidt ..... B08B 5/026 15/309.1
8,206,533 B2 * 6/2012 Hundorf ..... A61F 13/15658 156/199
8,499,410 B2 * 8/2013 Yoshimura ..... B08B 5/026 15/309.1
8,627,640 B2 1/2014 Ansaloni et al.
9,044,788 B2 * 6/2015 Kudo ..... G03G 15/0291
9,409,214 B2 * 8/2016 Jang ..... B08B 5/04
9,730,467 B2 * 8/2017 Van Gerwen ..... A22C 7/0038
10,273,027 B2 * 4/2019 Kepinski ..... B65B 41/12
2004/0020554 A1 2/2004 Smith et al.
2009/0165238 A1 * 7/2009 Bennett ..... B08B 5/026 15/309.1
2012/0180435 A1 7/2012 Stelluti
2013/0248563 A1 9/2013 Baker et al.
2014/0124990 A1 5/2014 Fowler et al.
2014/0298756 A1 10/2014 Amaranti et al.
2015/0174622 A1 * 6/2015 Bakker ..... B03C 7/06 134/1
2015/0336692 A1 * 11/2015 Brandt Sanz ..... B65B 37/00 53/450
2016/0340068 A1 * 11/2016 Brandt Sanz ..... B65B 9/042

FOREIGN PATENT DOCUMENTS

EP 2834154 B1 4/2016
JP H07124193 A 5/1995
JP H09202316 A 8/1997
JP 2003285016 A 10/2003

* cited by examiner

SEAL CLEANER AND PROCESS FOR SOLUBLE UNIT DOSE POUCHES CONTAINING GRANULAR COMPOSITION

FIELD OF THE INVENTION

Seal cleaner for use in making water soluble pouches containing a granular composition.

BACKGROUND OF THE INVENTION

Water soluble detergent pouches are becoming the laundry and dish detergent form of choice for many consumers. Consumers enjoy being able to use the detergent without having to come into contact with the detergent since some detergents may have a slimy feel and may be difficult to rinse from their skin.

Detergent pouches may contain one or more of powder composition, liquid composition, and combinations thereof. Pouches containing a powder composition can be particularly attractive to consumers and manufacturers since formulating such composition is simple as compared to liquid compositions.

A typical process used to form pouches containing powder detergent composition is to provide a bottom continuous web of water soluble film carried on a mold having one or more pockets and conforming the film to the pockets of the mold so that the web has a plurality of recesses. The recesses can be at least partially filled powder detergent composition. The detergent composition can be provided to the bottom film in registration with a pocket prior to conforming so that as the bottom film is conformed to the pocket the powder falls into or is deformed with the recess in the bottom film formed as the bottom film is conformed to the pocket. The composition can be provided in the recess as the bottom film is being conformed to the pocket or after the bottom film has been conformed to the pocket.

After the powder resides in the recess, a top continuous web of water soluble film is placed over the bottom continuous web and the top continuous web is bonded to seal landings between the recesses in the bottom continuous web to form an array of pouches. The array of pouches may extend in one or more of the machine direction and or cross direction. Downstream of the forming and filling operations the array of pouches is cut in one or more of the machine direction and or cross direction to provide individual pouches.

Dosing the powder to be in the desired locations on the film, whether flat film or conformed with a pocket to form a recess, can be difficult to control precisely. Often some, some of the granular material ends up being deposited on the seal landings between recesses. Granular material residing on the seal landings can interfere with achieving a coherent seal between the top continuous web and the bottom continuous web. Without a competent seal between the top continuous web and bottom continuous web to form the individual pouches, pouches may be prone to being messy to use and leak powder from the pouch during storage and or use, which can be dissatisfying to consumers, as mentioned above.

With these limitations in mind, there is a continuing unaddressed need for a seal cleaner and process of using a seal cleaner to enable the top continuous web and the bottom continuous web to be bonded to one another securely.

SUMMARY OF THE INVENTION

An apparatus comprising: a plurality of forming pockets spaced apart from one another in a machine direction and moveable in said machine direction, each said forming pocket having a longitudinal axis and a pair of transverse edges on opposing sides of said longitudinal axis; a chamber spaced apart from said forming pockets, wherein said chamber has an open slot oriented towards said forming pockets, wherein said slot is at least as laterally extensive away from said longitudinal axis as said transverse edges of said forming pockets; a plurality of pocket caps within said chamber spaced apart from one another and moveable in said machine direction across said slot, wherein said pocket caps are operatively coupled with said forming pockets and said pocket caps move in registration with said forming pockets; and an airflow generator in fluid communication with said chamber.

A process for cleaning seal landings with the apparatus of the preceding paragraph, said process comprising the steps of: providing a first web carried on said plurality of forming pockets, wherein said first web is conformed to said forming pockets and comprises a plurality of recesses coincident with said pockets and seal landings between said recesses, and wherein said recesses contain granular material; moving said plurality of pocket caps in said machine direction across said slot and in registration with said forming pockets; and providing airflow from proximal said seal landings, through said slot, and into said chamber to transport granular material from said seal landings into said chamber.

A process comprising the steps of: providing a plurality of forming pockets carrying a first web, wherein said forming pockets are spaced apart from one another in a machine direction and moving in said machine direction, wherein each said forming pocket having a longitudinal axis and a pair of transverse edges on opposing sides of said longitudinal axis, wherein said first web is conformed to said forming pockets and comprises a plurality of recesses coincident with said pockets and seal landings between said recesses, and wherein said recesses contain granular material; providing a chamber spaced apart from said first web, wherein said chamber has an open slot oriented towards said first web, wherein said slot is at least as laterally extensive away from said longitudinal axis as said transverse edges of said forming pockets; and providing airflow passing between said first web and said slot and entering said slot into said chamber to transport misplaced granular material from said seal landings into said chamber, wherein more of said airflow passes over said seal landings than over said recesses.

A process for cleaning seal landings said process comprising the steps of: providing a plurality of forming pockets spaced apart from one another in a machine direction and moving in said machine direction, each said forming pocket having a longitudinal axis and a pair of transverse edges on opposing sides of said longitudinal axis; providing a first web carried on said forming pockets; conforming said first web to said forming pockets to form a plurality of recesses in said first web with said seal landings between said recesses; depositing a granular material into said recesses; providing a chamber above said forming pockets and spaced apart from said first web, wherein said chamber has an open slot oriented towards said first web, wherein said slot is at least as laterally extensive as said transverse edges of said forming pockets; providing a plurality of pocket caps within said chamber spaced apart from one another and moving in said machine direction across said slot and in registration with said forming pockets; providing airflow above said seal landings and through said slot into said chamber to remove granular material from said seal landings.

DETAILED DESCRIPTION OF THE INVENTION

Figure 1:
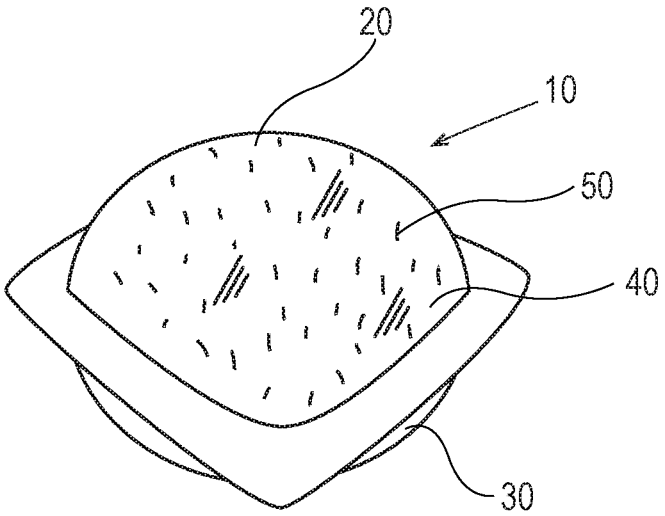
FIG. 1 is a water soluble pouch.

A water soluble pouch 10 is shown in FIG. 1. The water soluble pouch 10 can comprise a water soluble first sheet 20 and a water soluble second sheet 30 joined to the water soluble first sheet 20 to at least partially define a compartment 40 containing a granular material 50.

Figure 2:
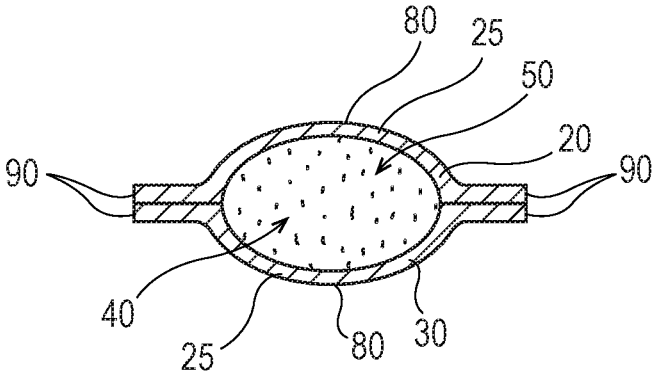
FIG. 2 is a cross section view of a water soluble pouch.

Each of the first sheet 20 and second sheet 30 can have an interior surface 70 and an opposing exterior surface 80, as shown in FIG. 2. The interior surface 70 of the first sheet 20 and second sheet 30 can together form a compartment 40. The edges 90 of the first sheet 20 and second sheet 30 can be joined to one another to form the compartment 40. Within the compartment 40, the granular material 50 can be disposed. At least one of the first sheet 20 and second sheet 30 can be a formed sheet 25. At least one of the first sheet 20 and second sheet 30 can be a thermoformed sheet 25. The interior surface 70 of the first sheet 20 and second sheet 30 can be oriented towards the compartment 40.

The edges 90 can each have a length less than about 100 mm, or even less than about 60 mm, or even less than about 50 mm. The plan view of the of the water soluble pouch 10 can be substantially rectangular, substantially square, substantially circular, elliptical, superelliptical, or any other desired shape that is practical to manufacture. The overall plan area of the water soluble pouch can be less than about 10000 $mm^2$, or even less than about 2500 $mm^2$. Sized and dimensioned as such, the water soluble pouch 10 can fit conveniently within the grasp of an adult human hand. Further, for water soluble pouches 10 intended for use in automatic dishwashing machines, such a size can conveniently fit in the detergent receptacle within the machine.

The edges 90 of the first sheet 20 and second sheet 30 can be bonded to one another. For example, the edges 90 of the first sheet 20 and second sheet 30 can be joined to one another by a thermal bond or a solvent weld or combination thereof. A thermal bond can be formed by applying one or more of heat and pressure to the two materials to be bonded to one another. A solvent weld can be formed by applying a solvent to one or both of the first sheet and second sheet and contacting the first sheet 20 and second sheet 30 in the location at which a bond is desired. For water soluble pouches, the solvent can be water and or steam.

The first sheet 20 and the second sheet 30 can be sufficiently translucent, or even transparent, such that the granular material 50 is visible from the exterior of the pouch 10. That is, the consumer using the pouch 10 can see the granular material 50 contained in the pouch 10.

Figure 3:
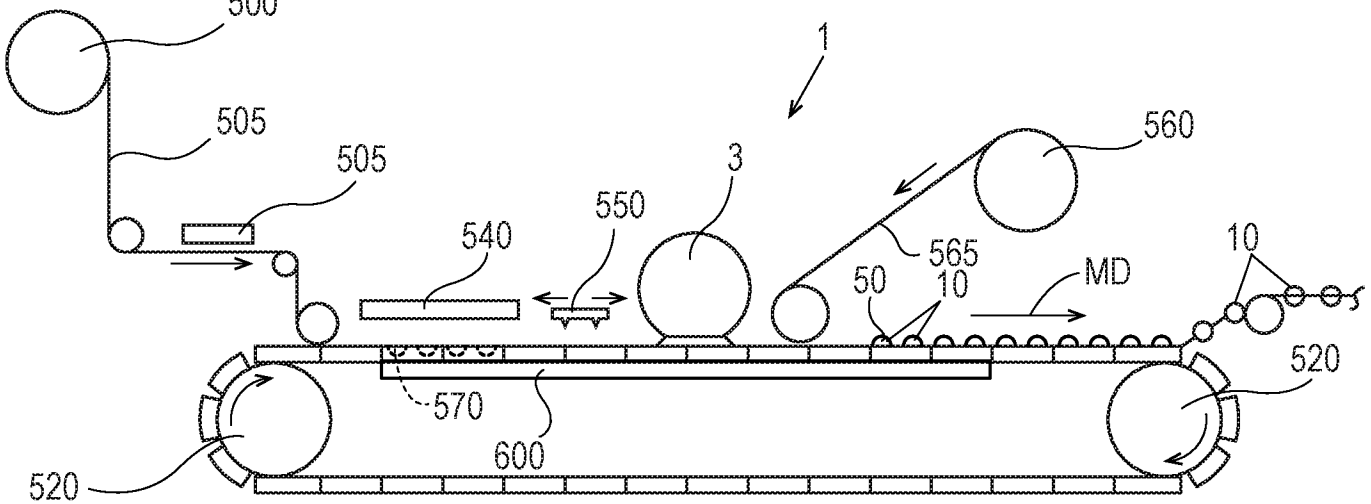
FIG. 3 is schematic of an apparatus for forming water soluble pouches.

A pouch forming machine 1 for forming a water soluble pouch 10 is shown in FIG. 3. The pouch forming machine 1 can comprise a first web feed roll 500, a printing unit 510, a conveyor system 520, a plurality of molds 530 movably mounted on the conveyor system 520, a heater 540, a dispenser 550, and a second web feed roll 560. Upstream of the dispenser 550, the pouch forming machine 1 can comprise a vacuum system 600. The first web 505 can be fed through the printing unit 510 prior to being place on the conveyor system 520. The printing unit 510 can print branding and use information on the first web. The first web 505 can then be fed onto the conveyor system 520. The conveyor system 520 can convey the molds 530 in the machine direction MD. The dispenser 550 can be movable in the machine direction MD and in a direction upstream of the machine direction MD. A seal cleaning apparatus 3 can be provided between the dispenser 550 and the location where the second web 565 is applied. Stated otherwise, the seal cleaning apparatus 3 can be downstream of the dispenser 550.

The printing unit 510 can be located between the first web feed roll 500 and the conveyor system 520. Optionally the printing unit 510 can be located between the second web feed roll 560 and the conveyor system 520. Optionally, the web feed roll 500 can be a pre-printed web feed roll having branding and use information disposed thereon and the printing unit 510 can be eliminated. Further optionally, the web feed roll 560 can be a pre-printed web feed roll having branding and use information disposed thereon and the printing unit 510 can be eliminated. The branding and or use information can be on either surface of the first web 505 or the second web, or if an additional web is provided then on such web.

The conveyor system 520 can convey the molds 530 and thereby first web 505 at a rate of from about 5 m/min to about 20 m/min, inclusive of any ranges of or single values of integers there between. The conveyor system 520 can be a belt or drum or other structure suitable for conveying molds 530.

Figure 4:
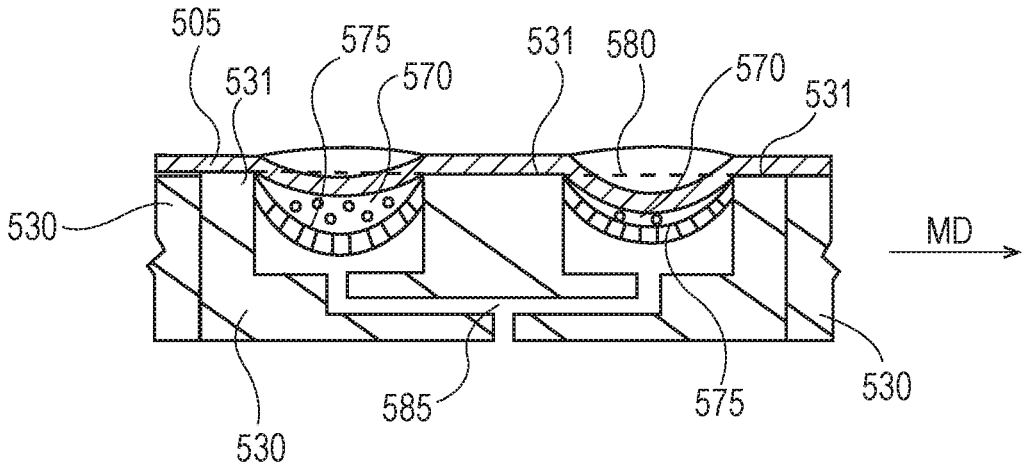
FIG. 4 is cross section view of a mold.

The conveyor system 520 can comprise a plurality of molds 530. The webs discussed herein can be held on the molds discussed herein by a web-holding vacuum system in the land areas of the molds. A cross section of a mold 530 is shown in FIG. 4. The mold 530 can be fabricated from aluminum. A mold 530 can have one or more forming pockets 570. The forming pockets 570 can have a porous face 575. There can be one or more molds 530 in the cross direction CD. The conveyor system 520 can convey the molds in the machine direction MD during formation and filling of the pouches 10. The molds 530 can be provided with one or more vacuum transmission systems 585. The molds 530 can have a vacuum system for holding the first web 505 on the molds 530. The molds 530 can have a land area 531 that surrounds the respective forming pocket 570.

The molds 530 provided can comprise a forming pocket 570. As the first web 505 is conveyed in the machine direction MD, the first web 505 can pass beneath a heater 540. The heater 540 can be an infrared lamp. The heater 540 can be an infrared lamp having a temperature of from about 300° C. to about 500° C. As the first web 505 passes beneath the heater 540, the first web 505 can be heated to the desired temperature. The distance between the heater 540 and the first web 505 can be adjustable so that the temperature of the first web 505 can be controlled. Similarly, the temperature of the heater 540 can be adjustable so that the temperature of the first web 505 can be controlled.

As the first web 505 is optionally being heated or after the first web 505 is optionally heated to the desired temperature, the molds 530 can be conveyed over a vacuum system 600.

The vacuum system 600 can be used to apply a negative gage pressure to the porous face 575 of the forming pocket 570. When the negative gage pressure is applied to the porous face 575 of the forming pocket 570, the first web 505 can be at a first maximum temperature.

The porous face 575 of the forming pocket 570 can comprise openings having an area from about 0.1 $mm^2$ to about 2 $mm^2$. The porous face 575 of the forming pocket 570 can comprise openings having an area from about 0.5 $mm^2$ to about 1 $mm^2$. The porous face 575 of the forming pocket 570 can comprise openings having an area from about 0.5 $mm^2$ to about 1.5 $mm^2$. The openings can be circular openings. There can be from about 2 to about 2000 openings. The openings can be sized such that at the temperature of deformation, plastic deformation, or thermoforming, the web is not drawn into the openings to a degree such that the structural integrity of the finished pouch 10 is compromised.

A forming pocket 570 in the mold 530 can have a volume from about 5 mL to about 300 mL. A forming pocket 570 in the mold 530 can have a volume from about 5 mL to about 40 mL. A forming pocket 570 in the mold 530 can have a volume from about 14 mL to about 18 mL.

The first maximum temperature can be from about 5° C. to about 100° C. The first maximum temperature can be from about 10° C. to about 100° C. The first maximum temperature can be from about 20° C. to about 100° C. The first maximum temperature can be from about 60 to about 100° C. The first maximum temperature can be such that the deformation of the first web 505 is by thermoforming. Thermoforming may provide for a finished pouch 10 that has lesser degree of micro-cracking as compared to a pouch 10 that is formed from a first web 505 that is deformed at a lower temperature.

The negative gage pressure can be from about 10 mbar to about 90 mbar below atmospheric pressure. The first web 505 can be subjected to the negative gage pressure for from about 1 s to about 10 s. The first web 505 can be subjected to the first negative pressure for from about 2 s to about 5 s. The first web 505 can be subjected to the first negative pressure for from about 1 s to about 3 s. The negative gage pressure can be from about 10 mbar to about 40 mbar below atmospheric pressure. The negative gage pressure can be from about 25 mbar to about 35 mbar below atmospheric pressure. The water soluble first web 505 can have a temperature of from about 5° C. to about 100° C., or even from about 10° C. to about 100° C., or even from about 20° C. to about 100° C., when the negative gage pressure is applied to the first web 505. The lower the negative gage pressure the faster the first web 505 will be deformed. Slower deformation can reduce the amount of micro-cracking in the deformed first web 505. For a lower the temperature of deformation, the negative gage pressure may be greater, i.e. less vacuum, so that deformation of the first web 505 is slow, which can reduce micro-cracking in the first web 505.

For clarity, gage pressure is zero referenced at atmospheric pressure. It can be said a gage pressure of 50 mbar below atmospheric pressure is a negative gage pressure since it is pressure below atmospheric pressure. Since a negative gage pressure of 50 mbar below atmospheric pressure is below atmospheric pressure, it is a vacuum.

The negative gage pressure and first maximum temperature can be selected so that the recesses 580 are well formed, the first web 505 is not drawn into the openings in the porous face 575 to an unacceptable degree, and the amount of micro-cracking that occurs during deformation of the first web 505 is limited to an acceptable degree.

The application of the negative gage pressure can deform the first web 505 into the one or more forming pockets 570 of the molds 530. The application of the negative gage pressure can plastically deform the first web 505 into the one or more forming pockets 570 of the molds 530. The plastic deformation can be provided by thermoforming, thermoforming being considered to be a subset of plastic deformation. The first web 505 can be heated and drawn in to forming pockets 570 in the mold 530, as shown in FIG. 4. The first web 505 heated above ambient temperature can be drawn in by a vacuum applied to the porous face 575 of the forming pocket 570 via a vacuum transmission system 585. The vacuum transmission system 585 of the molds 530 can be in fluid communication with vacuum system 600 to apply the negative gage pressure.

After the negative gage pressure is applied to the first web 505, the thermoformed first web 505 can then be filled or partially filled with granular material 50 by the dispenser 550. The second web 565 is then brought into facing relationship with the molded first web 505 and sealed to the first web 505 to form a pouch 10. The second web 565 can be at a temperature of from about ambient temperature to about 120° C. The second web 565 can be at a temperature of from about 10° C. to about 120° C. The second web 565 can be at a temperature of from about 20° C. to about 120° C.

The granular material 50 can be placed on the water soluble first web 505 as part of the process of making a water soluble pouch 10. In terms of the granular material 50 being placed on the water soluble first web 505, that can occur prior to deformation of the water soluble first web 505 into a recesses 580, during deformation of the water soluble first web 505 into a recesses 580, or after the water soluble first web 505 has been deformed into a recesses 580, or during part of any of the aforesaid periods or overlapping with any of such periods.

Other approaches to forming the water soluble first web 505 to form a recesses 580 are contemplated. Fundamentally, all that is needed to deform the water soluble first web 505 into recesses 580 is to apply a difference in pressure across the water soluble first web 505 to conform the water soluble first web 505 to the porous face 575 of the forming pocket 570. For instance, the water soluble first web 505 can be formed into a recesses 580 by applying a first pressure difference across the water soluble first web 505 with the water soluble first web 505 at a first maximum temperature and subsequently applying a second pressure difference across the water soluble first web 505 with the water soluble first web 505 at a second maximum temperature. The second pressure difference can be greater than the first pressure difference. The second maximum temperature can be greater than or equal to the first maximum temperature. The first pressure difference across the water soluble first web 505 can be provided by, by way of non-limiting example, fluid pressure from above the mold. The fluid can be a heated fluid. The fluid pressure that can act on the water soluble first web 505 can be provided by a gas such as air or a liquid. For instance, nozzles can dispense fluid, by way of non-limiting example liquid or gas, under pressure in a direction towards the first web 505 to conform the first web 505 to the porous face 575 of the forming pocket 570.

As described herein, the first pressure difference can be applied by applying a negative gage pressure to the porous face 575.

Any suitable process of joining the first web 505 and the second web 565 may be used. The sealing may occur in the land area 531 between individual forming pockets 570 of the molds 530. Non-limiting examples of such means include heat sealing, solvent welding, solvent or wet sealing, and combinations thereof. Heat and or solvent can be applied to the entire surface of the sheet or only the area which is to form the seal can be treated with heat or solvent. The heat or solvent can be applied by any process, typically on the closing material, and typically only on the areas which are to form the seal. If solvent or wet sealing or welding is used, heat can also be applied. Wet or solvent sealing/welding processes include selectively applying solvent onto the area between the molds, or on the closing material, by for example, spraying or printing this onto these areas, and then applying pressure onto these areas, to form the seal. Sealing rolls and belts as described above that optionally also provide heat can be used, for example.

A cutting operation can be integral with or located downstream of the apparatus shown in FIG. 3 to separate the pouches 10 into individual pouches 10. The formed pouches 10 may then be cut by a cutting device. Cutting can be accomplished using any known process. The cutting can be done in continuous manner, optionally with constant speed and in a horizontal position. The cutting device can, for example, be a sharp item or a hot item, whereby in the latter case, the hot item 'burns' through the sheet/sealing area. The cutting device or devices can be a rotary die cutter to make cuts in the cross direction and a cutting wheel to make cuts in the machine direction MD.

From the viewpoint of an individual pouch 10, the process for making the water soluble pouch 10 is a multi-step process. A water soluble first sheet 20 is provided. A water soluble second sheet 30 is provided. A recess 580 is formed in one of the first sheet 20 and the second sheet 30 by plastically deforming such sheet. A granular material 50 can be placed in the recesses 580 or on the first sheet 20. And, the first sheet 20 and the second sheet 30 can be sealed to one another to form an enclosed pouch 10.

In the process of making the pouch 10, at least one of the first sheet 20 and the second sheet 30 is formed. In the process of making the pouch 10, at least one of the first sheet 20 and the second sheet 30 can be thermoformed. In the process of making the pouch 10, at least one of the first sheet 20 and the second sheet 30 can be plastically deformed. In the process of making the pouch 10, at least one of the first sheet 20 and the second sheet 30 can be deformed. Depending on the properties of the sheets forming the pouch 10, a sheet that is thermoformed to form the recesses 580 into which the granular material 50 is placed may partially rebound after the sheet is joined to the other sheet. Depending on the properties of the first sheet 20 and the second sheet 30, the pouch 10 can be designed to have more or less curved sheets.

When forming the pouches 10 as described herein, the sheet that is deformed to make the recesses 580 may rebound after the other sheet is joined thereto and the pouch 10 is formed. As the rebounding sheet contracts, the other sheet may be plastically deformed by the increase in pressure within the compartment 40 arising due to the contracting sheet. Thus, it is possible that even though only one sheet is deformed to make the recesses 580, both sheets may be plastically deformed when the sheet initially drawn in to the forming pocket 570 rebounds. Heat can optionally be applied to the sheet that was not plastically deformed into the forming pocket 570 such that plastic deformation of the other sheet can be by thermoforming as well as by way of the rebounding of the one sheet driving deformation of the other sheet.

A forming pocket 570 in the mold 530 can have a surface area from about 20 to about 80 $cm^2$. As the first web 505 is transformed into a recesses 580, the deformed, plastically deformed, or thermoformed portion of the first web 505 can increase in area from about 50 to about 300% as compared to the area of the portion of the first web 505 subject to deformation, plastic deformation, or thermoforming prior to deformation, plastic deformation, or thermoforming.

Figure 5:
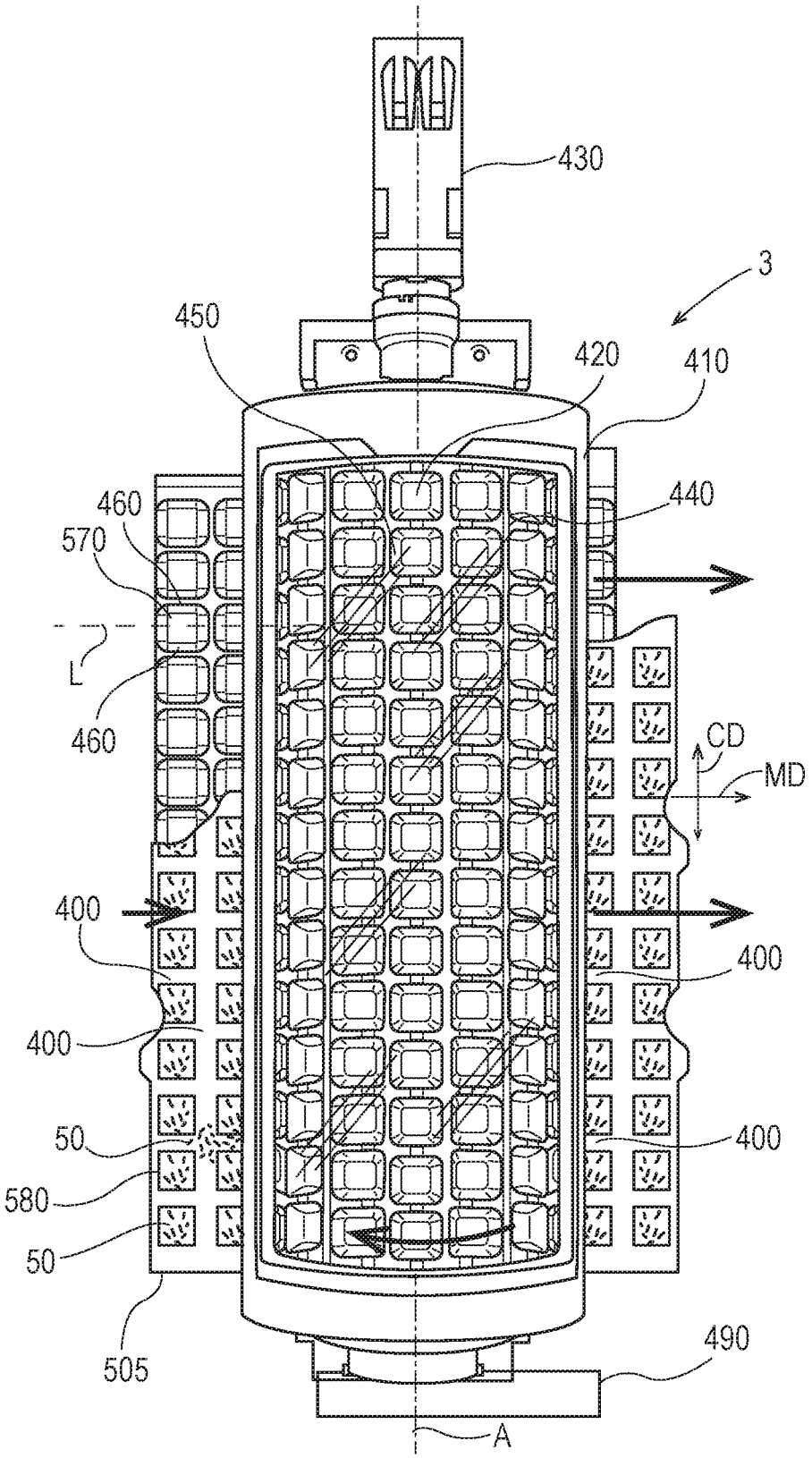
FIG. 5 is top view of seal cleaning apparatus, the embodiment illustrated having a window through which the interior workings may be observed.

FIG. 5 is a top view of a seal cleaning apparatus 3 for cleaning seal landings 400. In FIG. 5, the direction of material flow is from left to right in the machine direction MD. The pouch forming machine 1 and the apparatus 3 for cleaning seal landings 400 can have a cross direction CD orthogonal to the machine direction MD. The first web 505 being provided with recesses 580 containing granular material 50 is fed into the apparatus 3 to clean the seal landings 400. As shown in FIG. 5 in the portion of the first web 505 in the lower left portion, by way of non-limiting example, it is possible that some granular material 50 is misplaced on a seal landing 400. The seal landings 400 is above the land areas 531 of molds 530 and are between the various forming pockets 570. As the first web 505 passes beneath the apparatus 3 for cleaning seal landings 400, the apparatus 3 removes the misplaced granular material 50 that resides on the seal landings 400.

The cleaning of the seal landings 400 can be done by way of a system that includes a chamber 410 spaced apart from the forming pockets 570. Within the chamber 410 can be a plurality of pocket caps 420 spaced apart from one another. The pocket caps 420 can be moveable in the machine direction MD. The pocket caps 420 can be operatively coupled with the forming pockets 570 and the pocket caps 420 can move in registration with the forming pockets 570. The pocket caps 420 and forming pockets 570 can be operatively coupled with one another by way of an electronic control system that controls the drive motor 430 of the seal cleaning apparatus 3 and the motor or motors that drive movement of the conveyor system 520. Optionally, the operative coupling can be accomplished by way of a mechanical linkage, such as, but not limited to, a chain linkage or bar linkage or other way of coupling the movement of the seal cleaning apparatus 3 and the conveyor system 520. During the process, the pocket caps the plurality of pocket caps 420 within the chamber 410 can be moving in the machine direction MD across the slot and in registration with the forming pockets 570.

The chamber 410 houses the pocket caps 420 and the pocket caps 420 can be moveable within the chamber 410. In the embodiment shown in FIG. 5, the pocket caps 420 are rotatable within the chamber 410. The individual pocket caps 420 can be connected to a frame 440. The frame 440 can be connected the drive motor 430 such that the pocket caps 420 can be rotated about a central axis A.

As the first web 505 having recesses 580 is fed beneath the seal cleaning apparatus 3, individual pocket caps 420 associated with a particular individual recess 580 move in registration with the particular individual recess 580. Airflow can be provided through the chamber 410 by way of either positive gage pressure from outside the chamber 410 forcing airflow from a source into the space between the seal cleaning apparatus 3 and the first web 505. Alternatively, and perhaps more conveniently, airflow can be provided to the space between the seal cleaning apparatus 3 and the first web 505 through the chamber by way of a vacuum pump downstream of the chamber 410. Airflow created in either in the space between the seal cleaning apparatus 3 and the first web 505 can act to suspend misplaced granular material 50 that resides on a seal landing 400. The air suspended granular material 50 is then transported from above the first web 505 into the chamber 410. Once in the chamber 410, the granular material 50 can be captured in some manner, for example by way of electrostatics or some other fine particle gathering technique or can be transport by airflow out of the chamber 410 to a collection location and optionally re-circulated back to the dispenser 550.

As shown in FIG. 5, the forming pockets 570 can be spaced apart from one another in the machine direction MD. Each of the forming pockets 570 can have a longitudinal axis L and a pair of transverse edges 460 on opposing sides of the longitudinal axis L. The width of each pocket can be considered to be the maximum distance between transverse edges 460 of the pocket. The forming pockets 570 can be moveable in the machine direction MD. The forming pockets 570 can have any three dimensional shape that is appropriate for forming pouches. For instance, the shape of the forming pocket 570 in a plane defined by the machine direction MD and cross direction CD can be square, rectangular, oval, circular, irregular, or the like.

The chamber 410 can optionally have a window 450 so that the operator can inspect the operation of the seal cleaning apparatus 3 without disassembling the seal cleaning apparatus 3.

If a vacuum pump is employed as the airflow generator 490 to generate airflow across the seal landings 400 to suspend misplaced granular material 50, the vacuum pump can be located as shown in FIG. 5 or elsewhere downstream of the chamber 410. Optionally, a positive pressure pump can be located upstream of the slot outside of the chamber 410 to drive airflow across the seal landings 400.

Figure 6:
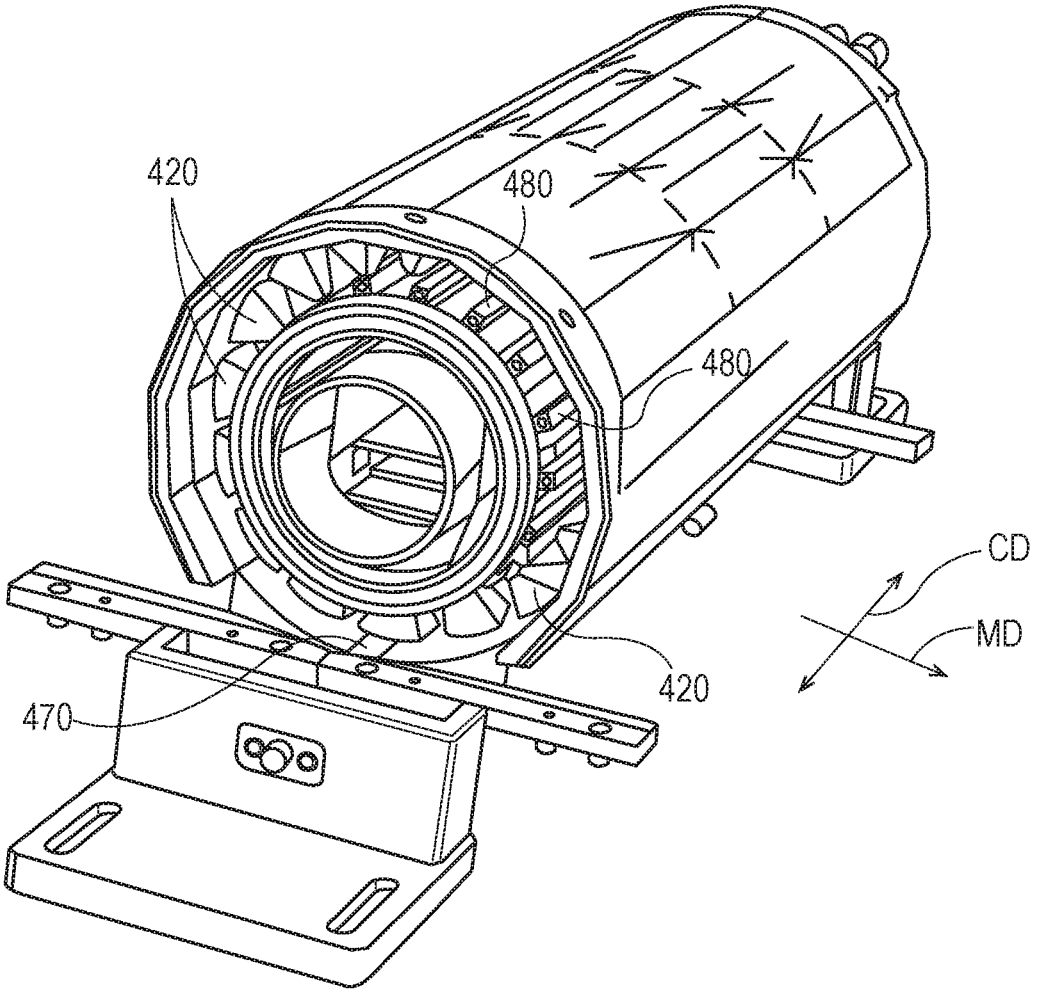
FIG. 6 is a perspective view of a seal cleaning apparatus.
Figure 7:
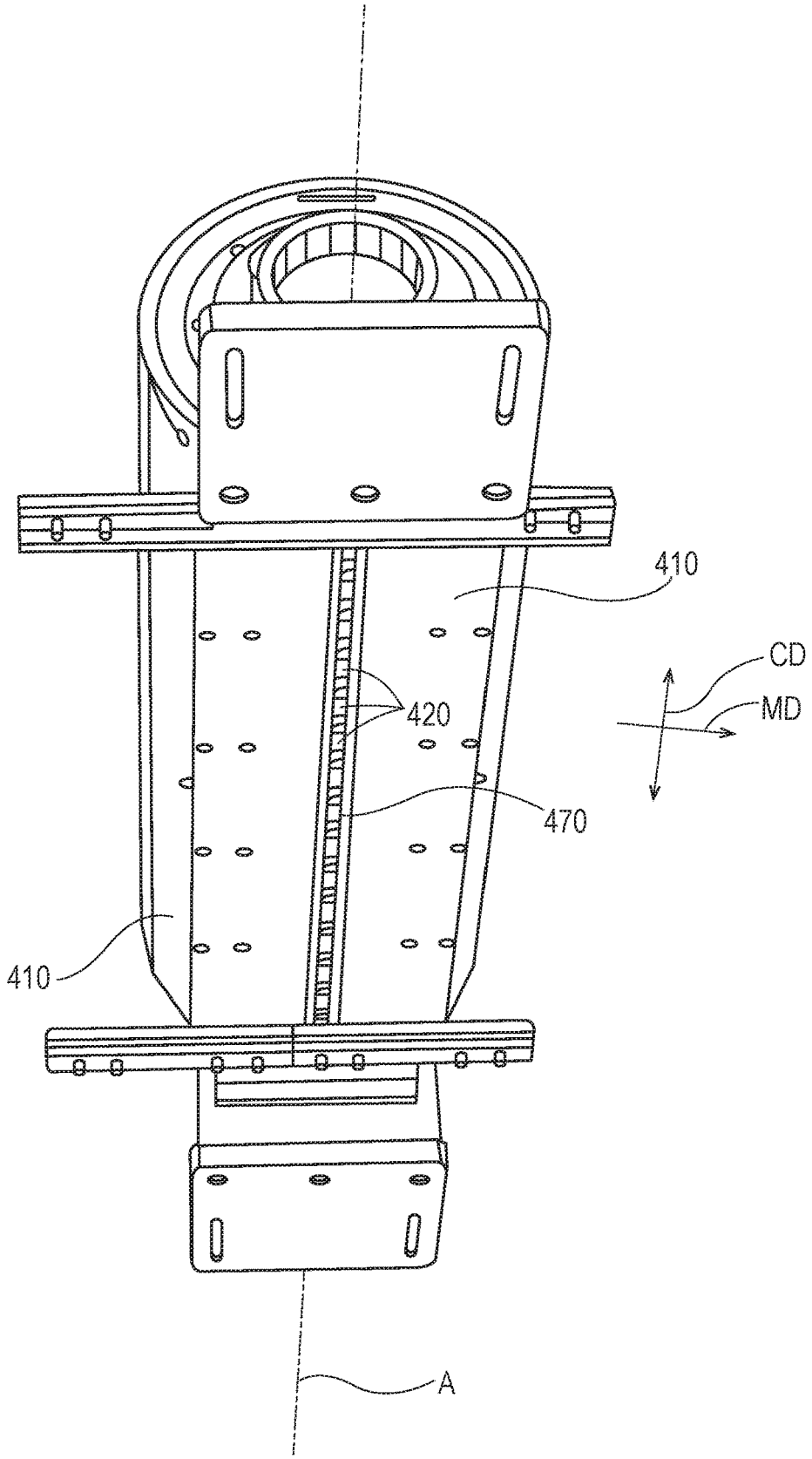
FIG. 7 is a bottom view of a seal cleaning apparatus.

A perspective view of the apparatus 3 is shown in FIG. 6, with the portion of the apparatus shown at the bottom of FIG. 5 oriented towards the viewer. In FIG. 6, the side of the chamber 410 is removed so that the internal workings within the chamber 410 are visible. As shown in FIG. 6, the chamber 410 can have a slot 470. The slot 470 is oriented towards the forming pockets 570. The slot 470 can provide the pathway for fluid communication, in this case airflow, from proximal the seal landings 400 into the chamber 410. The interior of the chamber 410 can be isolated from the first web 505 and the underlying forming pockets 570 except for the slot 470. The slot 470 can be at least as laterally extensive away from the longitudinal axis L of a the forming pocket 570 passing by the slot 470 as the transverse edges 460 of such forming pocket 570. By laterally extensive it is meant in the off machine direction MD across the first web 505, not necessarily orthogonal to the machine direction MD. For instance if the pocket caps 420 are provided as part of a belt system, the slot 470 could be run at a diagonal to the machine direction MD across the first web 505 and still provide for seal cleaning, just that seal cleaning in the cross direction CD, which is orthogonal to the machine direction MD, may not occur simultaneously at all locations in the cross direction CD at a particular location in the machine direction MD. Conveniently, the slot 470 can be orthogonal to the machine direction MD, which is the cross direction CD, as shown in FIGS. 5 and 6.

If the apparatus 3 provides for a single lane of forming pockets 570, and commensurately a single lane of pocket caps 420 that move in registration with the forming pockets, and the slot 470 is only as laterally extensive as the forming pocket 570 passing by the slot 470, then the apparatus can act to clean the seal landing 400 between individual forming pockets 570 in the machine direction MD. It can be beneficial to have the slot 470 more laterally extensive than the transverse edges 460 of the forming pocket 570 so that the seal landings 400 proximal the transverse edges 460 of the forming pockets 570 can be cleaned as well. In general, a desirable arrangement can be that the component width of the slot 470 in the cross direction CD is greater than the pocket width if a single lane of forming pockets 570 is provided. If there are plurality of forming pockets 570 in the cross direction CD, the component width of the slot 470 in the cross direction CD can desirably be greater than the sum of the widths of the forming pockets 570 and sum of the widths of the land areas 531 between those forming pockets 570.

It is contemplated that the pocket caps 420 can be connected to a moveable belt within the chamber 410. For instance, the forming pockets 570 can be provided as a part of a belt system and the forming pocket caps 420 can move in the machine direction MD as part of another belt system. This can be envisioned by imagining the chamber 420 in FIG. 5 being unwrapped so that it lies essentially flat over the forming pockets 570 and the pocket caps 420 move through or past a chamber 410 and over the slot 470. In essence, the apparatus 3 can be a belt above belt system with the bottom belt having or carrying a plurality of forming pockets 570 and the top belt having or carrying a plurality pocket caps 420, the pocket caps 420 passing through or in fluid communication with the chamber 410 and over the slot 470.

If multiple lanes of forming pockets 570 are provided, the slot 470 can extend across width of the first web 505. The slot 470 can extend across the multiple lanes of forming pockets 570 in the cross direction CD or in another direction that is off-machine direction MD, for instance diagonal. The slot 470 can extend across the multiple lanes of forming pockets 570 in the cross direction CD or in another direction that is off-machine direction MD, for instance in a curvilinear shape or irregular curvilinear shape.

In the embodiment shown in FIGS. 5 and 6, the pocket caps 420 are connected to a rotating frame 480 within the chamber 410. The pocket caps 420 can be spaced apart from one another in the machine direction MD and in the cross direction CD orthogonal to the machine direction MD. The pocket caps 420 can be spaced apart from one another in the cross direction CD. Most simply the forming pockets 570 and pocket caps 420 can be laid out in a regular grid orientation in which the forming pockets 570 and pocket caps 420 are aligned with one another in the machine direction MD and aligned with one another in the cross direction CD. Of course, if the pocket caps 420 are provided in a flat belt system the grid for the pocket caps can be flat as well. If the pocket caps 420 are provided in a manner to rotate within the chamber 410, that grid can be laid out in a generally cylindrical manner. The forming pockets 570 and pocket caps 420 can be laid out in a staggered relationship relative to the cross direction CD. Similarly, the forming pockets 570 and the pocket caps 420 need not be aligned with one another in the machine direction MD. What can be desired is that the forming pockets 570 and pocket caps 420 are registered with one another as they move relative to the slot 470 with the slot 470 having a component dimension in the cross direction CD that extends at least broadly as the transverse edges 460 of the forming pockets 570 that pass beneath such slot 470.

Airflow across the seal landings 400 to suspend granular material 50 misplaced onto the seal landings 400 can be provided by providing for airflow from external to the slot 470 towards the interior of the chamber 410. Airflow can be provided by an airflow generator 490. Airflow can be provided by a positive pressure pump upstream of said slot. That is regardless of the relative pressures internal to the chamber 410 and external the slot 470, the air pressure external the slot 470 is greater than the air pressure within the chamber 410. Optionally, and possibly more conveniently, a vacuum pump can be provided as an airflow generator 490 downstream of the chamber. Upstream and downstream with respect to airflow refers to the direction of airflow from across the seal landings 400, through the slot 470, into the chamber 410, and out of the chamber 410.

The forming pockets 570 and pocket caps 420 can desirably have similar, if not the same shape in plan view, with account being taken if the pocket caps 420 are rotationally mounted within the chamber 410. The forming pockets 570 can be considered to have a forming pocket plan shape in a forming pocket plane parallel with the machine direction MD and a cross direction CD orthogonal to the machine direction MD and the pocket caps 420 can have a pocket cap plan shape in a pocket cap plane parallel with the machine direction MD and the cross direction CD, wherein the forming pocket plan shape is substantially the same as the pocket cap plan shape. Of course, in referring to the shapes of the pocket caps 420, if such pocket caps 420 are rotationally mounted within the chamber 410, the relative shapes are considered in terms of the shape that passes the slot 470. That is, the pocket caps 420 are considered in an "unrolled" condition. A projection of the boundary of the forming pockets 570 onto the plane defined by the machine direction MD and cross direction CD can be substantially the same as a projection of the boundary of the pocket caps 420 projected onto the same plane. There need not be perfect one to one conformance between the plan shapes of the forming pocket 570 and the pocket cap 420 associated such forming pocket 570. Rather, the shape need to be similar enough such that the airflow generated across the seal landings 400 is sufficient to suspend misplace granular material 50.

The pocket caps 420 can closely conform to the interior of the chamber 410. For instance, as shown in FIGS. 5 and 6, the interior of the chamber 410 is cylindrical, although it could be substantially cylindrical optionally. The frame 480 upon which the pocket caps 420 are mounted can rotate within the chamber 410. The pocket caps 420 can spin around within the chamber 480 and serially move across the slot 470. The pocket caps 420 may slide against or be slightly spaced apart from the interior of the chamber 410.

Now as the pocket caps 420 move across the slot 470, airflow across the surface of the seal landings 400 moves through portions of the slot through which airflow will preferentially occur, recognizing that the pocket caps 420 will impede airflow, or optionally block airflow, as compared to portions of the slot through which airflow is not impeded, or optionally blocked, by the pocket caps 420. There need not be perfect contact of fitting of the pocket caps 420 with the interior of the chamber 410 and where the pocket caps move across the slot 470, although conceivably the pocket caps 420 could be slideably engaged with the periphery of the slot 420 as they move across the slot and even sealably engaged with the interior of the chamber 410 proximal the slot 470. As the airflow moves across the seal landings, misplaced granular material 50 is suspended into the airflow. The airflow carrying the misplaced granular material 50 passes through the slot 470 preferentially through portions of the slot 470 away from the pocket caps 420 and into the interior of the chamber 410. Airflow will tend to primarily follow the path of least resistance into the chamber 410, recognizing that some small, or even minority, fraction of the airflow might occur beneath the pocket caps 420.

The pocket caps 420 can be hollowed out structures as shown in FIG. 5. Without being bound by theory, it is believed that hollowed out pocket caps 420 can help reduce the potential for the airflow to suspend granular material 50 contained in the recesses 580 as compared to pocket caps 420 that present a flat surface towards the slot 470. The pocket caps 420 can be considered to have a slot facing surface that is hollowed and is oriented towards the slot 470.

In operation of the apparatus 3, it can be practical to be able to provide airflow above the seal landings 400 at a velocity of from about 20 to about 80 m/s. Such a velocity is thought to be sufficient to suspend typical granular materials 50 having the particle size, surface texture, and density as dish or laundry powder detergents commonly available in the market. The separation distance between the opening of the slot 470 and the seal landings 400 can be from about 1 mm to about 5 mm, and possibly even about 2 mm Depending on the size of the chamber 410, the absolute pressure within the chamber can be from about −400 to about −100 mbar absolute. In general, the absolute pressure within the chamber 410 is set so as to provide the desired air velocity above the seal landings 400.

The apparatus 3 can be employed in a process of forming water soluble pouches. In the process, a plurality of forming pockets 570 carrying a first web 505. The forming pockets 570 can be spaced apart from one another in the machine direction MD and moving in the machine direction MD. Each of the forming pockets 570 can have a longitudinal axis L and a pair of transverse edges 460 on opposing sides of the longitudinal axis L. The first web 505 can be conformed to the forming pockets 570 and comprise a plurality of recesses 580 coincident with the forming pockets 570 and seal landings 400 between the recesses 580. The recesses 580 can contain a granular material 50. A chamber 410 can be provided spaced apart from the first web 505. The chamber 410 can have an open slot 470 oriented towards the first web 505. The slot 470 can be at least a laterally extensive away from the longitudinal axis L as the transverse edges of the forming pockets 570.

Airflow can be provided that passes between the first web 505 and the slot 470 and enters into the slot 470 into the chamber 410. More of the airflow can pass over the seal landings 400 than over the recesses 580. Together, the chamber 410 and slot 470 can be designed to provide for airflow that is primarily directed towards being over the seal landings 400 as compared to the airflow over the recesses 580. The preferential airflow can be provided by obstructions, such as the pocket caps 420 described herein. Optionally, the preferential airflow can be provided by a flow manifold that provides for airflow preferentially across the seal landings 400. For example, the airflow can be provided by a network of air channels that are sized and dimensioned to have a shape and pattern substantially similar to the shape and pattern of the seal landings 400. Such shaping and patterning of air channels selectively driving a majority of the airflow across the seal landings as compared to airflow that passes over the recesses 580.

Granular material 50 can be a powder, agglomerate, capsules, beads, noodles, balls or mixtures thereof. The granular material 50 of the present invention can comprise a surfactant. The total surfactant level may be in the range of from about 1% to about 80% by weight of the granular material 50.

The granular material 50 can be selected from the group consisting of powdered laundry detergent, powder dishwashing detergent, powdered bleaching agent, powdered fabric softener, powder laundry scent additive, and a solid fabric care benefit agent. The granular material 50 can be a fabric softener comprising a quaternary ammonium salt and or a dehydrogenated tallow dimethyl ammonium chloride and or a diethyl ester dimethyl ammonium chloride. A granular material 50 can be formulated to treat a substrate selected from the group consisting of glassware, dishware, flooring, textiles, tires, automobile bodies, teeth, dentures, skin, fingernails, toenails, hair, appliance surfaces, appliance interiors, toilets, bathtubs, showers, mirrors, deck materials, windows, and the like.

The first web 505 and second web 565 can be a water soluble material. The water soluble material can be a polymeric material that can be formed into a sheet or film. The sheet material can, for example, be obtained by casting, blow-molding, extrusion or blown extrusion of the polymeric material, as known in the art.

The first web 505 and second web 565 can have a thickness of from about 20 to about 150 microns, or even about 35 to about 125 microns, or even about 50 to about 110 microns, or even about 76 microns or even about 90 microns.

The first web 505 and second web 565, first sheet 20, and second sheet 30 can have a water-solubility of at least 50%, or even at least 75%, or even at least 95%, as measured by the method set out hereafter using a glass-filter with a maximum pore size of 20 microns: 50 grams±0.1 gram of sheet material is added in a pre-weighed 400 ml beaker and 245 ml±1 ml of distilled water is added. This is stirred vigorously on a magnetic stirrer, labline model No. 1250 or equivalent and 5 cm magnetic stirrer, set at 600 rpm, for 30 minutes at 24° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Suitable polymers, copolymers or derivatives thereof suitable for use as the first web 505 and second web 565 and pouch 10 material can be selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. Suitable polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and suitably selected from polyvinyl alcohols, polyvinyl alcohol copolymers and hydroxypropyl methyl cellulose (HPMC), and combinations thereof. The level of polymer in the sheet material, for example a PVA polymer, can be at least 60%. The polymer can have any weight average molecular weight, such as from about 1000 to about 1,000,000, or even from about 10,000 to about 300,000, or even from about 20,000 to about 150,000.

Mixtures of polymers can also be used as the first web 505, second web 565, and as the pouch 10 material. This can be beneficial to control the mechanical and/or dissolution properties of the compartments or sheet, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000 to about 40,000, or even about 20,000, and of PVA or copolymer thereof, with a weight average molecular weight of about 100,000 to about 300,000, or even about 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1 to about 35% by weight polylactide and about 65% to about 99% by weight polyvinyl alcohol. Suitable for use herein are polymers which are from about 60% to about 98% hydrolysed, or even about 80% to about 90% hydrolysed, to improve the dissolution characteristics of the material.

The first web 505 and second web 565 and pouch 10 material can exhibit good dissolution in cold water, meaning unheated distilled water. Such films can exhibit good dissolution at a temperature of about 24° C., or even about 10° C. By good dissolution it is meant that the sheet exhibits water-solubility of at least about 50%, or even at least about 75%, or even at least about 95%, as measured by the method set out herein and described above.

Suitable first web 505 and second web 565 can be webs supplied by Monosol under the trade references M8630, M8900, M8779, M8310, films described in U.S. Pat. Nos. 6,166,117 and 6,787,512 and PVA films of corresponding solubility and deformability characteristics. Further suitable sheets can be those described in US2006/0213801, WO 2010/119022 and U.S. Pat. No. 6,787,512.

Suitable first web 505 and second web 565 and pouch 10 materials can be those resins comprising one or more PVA polymers. The water soluble sheet resin can comprise a blend of PVA polymers. For example, the PVA resin can include at least two PVA polymers, wherein as used herein the first PVA polymer has a viscosity less than the second PVA polymer. A first PVA polymer can have a viscosity of at least 8 centipoise (cP), 10 cP, 12 cP, or 13 cP and at most 40 cP, 20 cP, 15 cP, or 13 cP, for example in a range of about 8 cP to about 40 cP, or 10 cP to about 20 cP, or about 10 cP to about 15 cP, or about 12 cP to about 14 cP, or 13 cP. Furthermore, a second PVA polymer can have a viscosity of at least about 10 cP, 20 cP, or 22 cP and at most about 40 cP, 30 cP, 25 cP, or 24 cP, for example in a range of about 10 cP to about 40 cP, or 20 to about 30 cP, or about 20 to about 25 cP, or about 22 to about 24, or about 23 cP. The viscosity of a PVA polymer is determined by measuring a freshly made solution using a Brookfield LV type viscometer with UL adapter as described in British Standard EN ISO 15023-2: 2006 Annex E Brookfield Test method. It is international practice to state the viscosity of 4% aqueous polyvinyl alcohol solutions at 20° C. All viscosities specified herein in cP should be understood to refer to the viscosity of 4% aqueous polyvinyl alcohol solution at 20° C., unless specified otherwise. Similarly, when a resin is described as having (or not having) a particular viscosity, unless specified otherwise, it is intended that the specified viscosity is the average viscosity for the resin, which inherently has a corresponding molecular weight distribution.

The individual PVA polymers can have any suitable degree of hydrolysis, as long as the degree of hydrolysis of the PVA resin is within the ranges described herein. Optionally, the PVA resin can, in addition or in the alternative, include a first PVA polymer that has a Mw in a range of about 50,000 to about 300,000 Daltons, or about 60,000 to about 150,000 Daltons; and a second PVA polymer that has a Mw in a range of about 60,000 to about 300,000 Daltons, or about 80,000 to about 250,000 Daltons.

The PVA resin can still further include one or more additional PVA polymers that have a viscosity in a range of about 10 to about 40 cP and a degree of hydrolysis in a range of about 84% to about 92%.

When the PVA resin includes a first PVA polymer having an average viscosity less than about 11 cP and a polydispersity index in a range of about 1.8 to about 2.3, then in one type of embodiment the PVA resin contains less than about 30 wt % of the first PVA polymer. Similarly, when the PVA resin includes a first PVA polymer having an average viscosity less than about 11 cP and a polydispersity index in a range of about 1.8 to about 2.3, then in another, non-exclusive type of embodiment the PVA resin contains less than about 30 wt % of a PVA polymer having a Mw less than about 70,000 Daltons.

Of the total PVA resin content in the film described herein, the PVA resin can comprise about 30 to about 85 wt. % of the first PVA polymer, or about 45 to about 55 wt. % of the first PVA polymer. For example, the PVA resin can contain about 50 wt. % of each PVA polymer, wherein the viscosity of the first PVA polymer is about 13 cP and the viscosity of the second PVA polymer is about 23 cP.

One type of embodiment is characterized by the PVA resin including about 40 to about 85 wt % of a first PVA polymer that has a viscosity in a range of about 10 to about 15 cP and a degree of hydrolysis in a range of about 84% to about 92%. Another type of embodiment is characterized by the PVA resin including about 45 to about 55 wt % of the first PVA polymer that has a viscosity in a range of about 10 to about 15 cP and a degree of hydrolysis in a range of about 84% to about 92%. The PVA resin can include about 15 to about 60 wt % of the second PVA polymer that has a viscosity in a range of about 20 to about 25 cP and a degree of hydrolysis in a range of about 84% to about 92%. One contemplated class of embodiments is characterized by the PVA resin including about 45 to about 55 wt % of the second PVA polymer. When the PVA resin includes a plurality of PVA polymers the PDI value of the PVA resin is greater than the PDI value of any individual, included PVA polymer. Optionally, the PDI value of the PVA resin is greater than 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.5, or 5.0.

The PVA resin can have a weighted, average degree of hydrolysis ($\overline{H^{\sigma}}$) between about 80 and about 92%, or between about 83 and about 90%, or about 85 and 89%. For example, $\overline{H^{\sigma}}$ for a PVA resin that comprises two or more PVA polymers is calculated by the formula $\overline{H^{\sigma}}=\Sigma(Wi\cdot H_i)$ where $W_i$ is the weight percentage of the respective PVA polymer and a $H_i$ is the respective degrees of hydrolysis. Still further it can be desirable to choose a PVA resin that has a weighted log viscosity ($\overline{\mu}$) between about 10 and about 25, or between about 12 and 22, or between about 13.5 and about 20. The $\overline{\mu}$ for a PVA resin that comprises two or more PVA polymers is calculated by the formula $\overline{\mu}=e^{\Sigma W_i \cdot ln\ \mu_i}$ where $\mu_t$ is the viscosity for the respective PVA polymers.

Yet further, it can be desirable to choose a PVA resin that has a Resin Selection Index (RSI) in a range of about 0.255 to about 0.315, or about 0.260 to about 0.310, or about 0.265 to about 0.305, or about 0.270 to about 0.300, or about 0.275 to about 0.295, or about 0.270 to about 0.300. The RSI is calculated by the formula; $\Sigma(W_i|\mu_i-\mu_t|)/\Sigma(W_i\mu_i)$, wherein $\mu_t$ is seventeen, $\mu_i$ is the average viscosity each of the respective PVOH polymers, and $W_i$ is the weight percentage of the respective PVOH polymers.

Also suitable are water soluble first web 505 and water soluble second web 505 and pouch 10 materials or sheets comprising a least one negatively modified monomer with the following formula:

$$[Y]-[G]_n$$

wherein Y represents a vinyl alcohol monomer and G represents a monomer comprising an anionic group and the index n is an integer of from 1 to 3. G can be any suitable comonomer capable of carrying of carrying the anionic group, optionally G is a carboxylic acid. G can be selected from the group consisting of maleic acid, itaconic acid, coAMPS, acrylic acid, vinyl acetic acid, vinyl sulfonic acid, allyl sulfonic acid, ethylene sulfonic acid, 2 acrylamido 1 methyl propane sulfonic acid, 2 acrylamido 2 methyl propane sulfonic acid, 2 methyl acrylamido 2 methyl propane sulfonic acid and mixtures thereof.

The anionic group of G can be selected from the group consisting of $OSO_3M$, $SO_3M$, $CO_2M$, $OCO_2M$, $OPO_3M_2$, $OPO_3HM$ and $OPO_2M$. Suitably, the anionic group of G can be selected from the group consisting of $OSO_3M$, $SO_3M$, $CO_2M$, and $OCO_2M$. Suitably, the anionic group of G can be selected from the group consisting of $SO_3M$ and $CO_2M$.

Naturally, different webs (first web 505, second web 565), sheet material and/or sheets of different thickness may be employed in making the compartments of the present invention. A benefit in selecting different films is that the resulting compartments may exhibit different solubility or release characteristics.

The web (first web 505, second web 565) and sheet material herein can also comprise one or more additive ingredients. For example, it can be beneficial to add plasticizers, for example glycerol, ethylene glycol, diethyleneglycol, propylene glycol, sorbitol and mixtures thereof. Other additives may include water and functional detergent additives, including surfactant, to be delivered to the wash water, for example organic polymeric dispersants, etc.

Combinations

An example is below:

A. An apparatus (3) comprising:
- a plurality of forming pockets (570) spaced apart from one another in a machine direction (MD) and moveable in said machine direction, each said forming pocket having a longitudinal axis (L) and a pair of transverse edges (460) on opposing sides of said longitudinal axis;
- a chamber (410) spaced apart from said forming pockets, wherein said chamber has an open slot (470) oriented towards said forming pockets, wherein said slot is at least as laterally extensive away from said longitudinal axis as said transverse edges of said forming pockets;
- a plurality of pocket caps (420) within said chamber spaced apart from one another and moveable in said machine direction across said slot, wherein said pocket caps are operatively coupled with said forming pockets and said pocket caps move in registration with said forming pockets; and
- an airflow generator (490) in fluid communication with said chamber.

B. The apparatus according to Paragraph A, wherein said slot more laterally extensive than said transverse edges of said forming pockets.

C. The apparatus according to Paragraph A or B, wherein said pocket caps are connected to a rotating frame (480) within said chamber.

D. The apparatus according to Paragraph A or B, wherein said pocket caps are connected to a moveable belt within said chamber.

E. The apparatus according to any one of Paragraphs A to D, wherein said plurality of pockets are spaced apart from one another in said machine direction and in a cross direction (CD) orthogonal to said machine direction said plurality of pocket caps are spaced apart from one another in said cross direction.

F. The apparatus according to any one of Paragraphs A to E, wherein said airflow generator is a vacuum pump downstream from said chamber.

G. The apparatus according to any one of Paragraphs A to E, wherein said airflow generator is a positive pressure pump upstream of said slot.

H. The apparatus according to any one of Paragraphs A to G, wherein said slot is orthogonal to said machine direction.

I. The apparatus according to any one of Paragraphs A to H, wherein said forming pockets have a forming pocket plan shape in a forming pocket plane parallel with said machine direction and a cross direction orthogonal to said machine direction and said pocket caps have a pocket cap plan shape in a pocket cap plane parallel with said machine direction and said cross direction, wherein said forming pocket plan shape is substantially the same as said pocket cap plan shape.

J. A process comprising the steps of:

providing a plurality of forming pockets (570) carrying a first web (505), wherein said forming pockets are spaced apart from one another in a machine direction (MD) and moving in said machine direction, wherein each said forming pocket has a longitudinal axis (L) and a pair of transverse edges (460) on opposing sides of said longitudinal axis, wherein said first web is conformed to said forming pockets and comprises a plurality of recesses (580) coincident with said pockets and seal landings (400) between said recesses, and wherein said recesses contain granular material (50);

providing a chamber (410) spaced apart from said first web, wherein said chamber has an open slot (470) oriented towards said first web, wherein said slot is at least as laterally extensive away from said longitudinal axis as said transverse edges of said forming pockets; and providing airflow passing between said first web and said slot and entering said slot into said chamber to transport misplaced granular material from said seal landings into said chamber, wherein more of said airflow passes over said seal landings than over said recesses.

K. The process according to Paragraph J, further comprising the step of providing a plurality of pocket caps (420) within said chamber spaced apart from one another and moving in said machine direction across said slot and in registration with said forming pockets.

L. The process according to any one of Paragraph J or K, wherein said slot more laterally extensive than said transverse edges of said forming pockets.

M. The process according to any one of Paragraphs J to L, wherein said pocket caps rotatable within said chamber.

N. The process according to any one of Paragraphs J to L, wherein said pocket caps are connected to a moveable belt within said chamber.

O. The a process according to any one of Paragraphs J to N, wherein said plurality of pockets are spaced apart from one another in said machine direction and in a cross direction orthogonal to said machine direction and said plurality of pocket caps are spaced apart from one another in said cross direction.

P. The process according to any one of Paragraphs J to O, wherein said airflow is provided by a vacuum pump downstream from said chamber.

Q. The process according to any one of Paragraphs J to O, wherein said airflow is provided by a positive pressure pump upstream of said slot.

R. The process according to any one of Paragraphs J to Q, wherein said slot is orthogonal to said machine direction.

S. The a process according to any one of Paragraphs J to R, wherein said forming pockets have a forming pocket plan shape in a forming pocket plane parallel with said machine direction and a cross direction orthogonal to said machine direction and said pocket caps have a pocket cap plan shape in a pocket cap plane parallel with said machine direction and said cross direction, wherein said forming pocket plan shape is substantially the same as said pocket cap plan shape.

T. A process for cleaning seal landings with the apparatus according to any one of Paragraphs A to I, said process comprising the steps of:

providing a first web (505) carried on said plurality of forming pockets, wherein said first web is conformed to said forming pockets and comprises a plurality of recesses (580) coincident with said pockets and seal landings between said recesses, and wherein said recesses contain granular material (50);

moving said plurality of pocket caps in said machine direction across said slot and in registration with said forming pockets; and providing airflow from proximal said seal landings, through said slot, and into said chamber to transport granular material from said seal landings into said chamber.

U. A process for cleaning seal landings said process comprising the steps of:

providing a plurality of forming pockets (570) spaced apart from one another in a machine direction (MD) and moving in said machine direction, each said forming pocket having a longitudinal axis (L) and a pair of transverse edges (460) on opposing sides of said longitudinal axis;

providing a first web (505) carried on said forming pockets;

conforming said first web to said forming pockets to form a plurality of recesses (580) in said first web with said seal landings between said recesses;

depositing a granular material (50) into said recesses;

providing a chamber (410) above said forming pockets and spaced apart from said first web, wherein said chamber has an open slot oriented towards said first web, wherein said slot is at least as laterally extensive as said transverse edges of said forming pockets;

providing a plurality of pocket caps within said chamber spaced apart from one another and moving in said machine direction across said slot and in registration with said forming pockets;

providing airflow above said seal landings and through said slot into said chamber to remove granular material from said seal landings.

V. The apparatus according to any one of Paragraphs A to I, wherein said forming pocket has a slot facing surface oriented towards said slot and said slot facing surface is hollowed.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus comprising:

a plurality of individual forming pockets spaced apart from one another in a machine direction and moveable in said machine direction, each said individual forming pocket having a longitudinal axis and a pair of transverse edges on opposing sides of said longitudinal axis;

a chamber spaced apart from said individual forming pockets, wherein said chamber has an open slot oriented towards at least one of said individual forming pockets during operation of said apparatus, wherein said slot is at least as laterally extensive away from said longitudinal axis as said transverse edges of said individual forming pockets;

a plurality of individual pocket caps within said chamber spaced apart from one another and moveable in said machine direction across said slot, wherein said apparatus is configured such that during operations at least one of said individual pocket caps is operatively coupled with a respective one of said individual forming pockets at a time, and said individual pocket caps move in registration with said individual forming pockets; and an airflow generator in fluid communication with said chamber.

2. The apparatus of claim 1, wherein said slot is more laterally extensive than said transverse edges of said individual forming pockets.

3. The apparatus of claim 1, wherein said individual pocket caps are connected to a rotating frame within said chamber.

4. The apparatus of claim 1, wherein said individual pocket caps are connected to a moveable belt within said chamber.

5. The apparatus of claim 1, wherein said individual forming pockets are spaced apart from one another in said machine direction and in a cross direction orthogonal to said machine direction and said individual pocket caps are spaced apart from one another in said cross direction.

6. The apparatus of claim 1, wherein said airflow generator is a vacuum pump downstream from said chamber.

7. The apparatus of claim 1, wherein said slot is orthogonal to said machine direction.

8. The apparatus of claim 1, wherein said individual forming pockets have a forming pocket plan shape in a forming, pocket plane, parallel with said machine direction and a cross direction orthogonal to said machine direction and said individual pocket caps have a pocket cap plan shape in a pocket cap plane parallel with said machine direction and said cross direction, wherein said forming pocket plan shape is the same as said pocket cap plan shape.

9. The apparatus of claim 1, wherein said individual pocket caps have a slot facing surface oriented towards said slot and said slot facing surface is hollowed.

10. A process for cleaning seal landings with the apparatus of claim 1, said process comprising the steps of: providing a first web carried on said plurality of individual forming pockets, wherein said first web is conformed to said individual forming pockets and comprises a plurality of individual recesses coincident with said individual forming pockets and seal landings between said individual recesses, and wherein said individual recesses contain granular material; moving said plurality of individual pocket caps in said machine direction across said slot and in registration with said individual forming pockets; and providing airflow from proximal said seal landings, through said slot, and into said chamber to transport granular material from said seal landings into said chamber.

* * * * *